US010995459B2

(12) United States Patent
Davis

(10) Patent No.: US 10,995,459 B2
(45) Date of Patent: May 4, 2021

(54) ADJUSTABLE CONCRETE FOOTER BULKHEAD

(71) Applicant: James L. Davis, Murphy, NC (US)

(72) Inventor: James L. Davis, Murphy, NC (US)

( * ) Notice: Subject to any disclaimer, the term of this patent is extended or adjusted under 35 U.S.C. 154(b) by 0 days.

(21) Appl. No.: 16/869,243

(22) Filed: May 7, 2020

(65) Prior Publication Data

US 2020/0354977 A1 Nov. 12, 2020

Related U.S. Application Data

(60) Provisional application No. 62/844,484, filed on May 7, 2019.

(51) Int. Cl.

| | |
|---|---|
| ***E01C 19/50*** | (2006.01) |
| ***E04G 13/00*** | (2006.01) |
| ***E04G 17/00*** | (2006.01) |
| ***E04G 9/02*** | (2006.01) |

(52) U.S. Cl.

CPC ..... *E01C 19/502* (2013.01); *E04G 9/02* (2013.01); *E04G 13/00* (2013.01); *E04G 17/00* (2013.01); *E04G 2017/008* (2013.01)

(58) Field of Classification Search

CPC ..... E04G 2017/008; E04G 9/00; E04G 9/02; E04G 13/00; E04G 17/00; E01C 19/50; E01C 19/502; E01C 19/508

USPC ..... 249/2, 3, 4, 5, 6, 7

See application file for complete search history.

(56) References Cited

U.S. PATENT DOCUMENTS

| | | | | | |
|---|---|---|---|---|---|
| 1,672,760 | A * | 6/1928 | Heltzel | E01C 19/502 | 249/208 |
| 1,700,798 | A * | 2/1929 | Heltzel | E01C 19/502 | 249/6 |
| 1,722,144 | A * | 7/1929 | Heltzel | E01C 19/502 | 249/6 |
| 2,907,089 | A * | 10/1959 | McCaffrey | E01C 19/502 | 249/6 |
| 3,288,426 | A * | 11/1966 | Simpson | E04G 9/08 | 249/192 |
| 3,753,545 | A * | 8/1973 | Stegmeier | E04G 17/00 | 249/219.1 |
| 3,778,019 | A * | 12/1973 | Stegmeier | E04H 4/00 | 249/189 |

(Continued)

FOREIGN PATENT DOCUMENTS

| | | | | |
|---|---|---|---|---|
| CA | 2132252 A1 * | 3/1996 | E04G 9/06 | |
| DE | 3442156 A1 * | 5/1986 | E04G 13/00 | |

(Continued)

*Primary Examiner* — Michael Safavi

(74) *Attorney, Agent, or Firm* — William G. Heedy; The Van Winkle Law Firm

(57) ABSTRACT

An adjustable concrete footer bulkhead for pouring concrete footers includes a center body; a first slide body and a second slide body each having equal heights; a first rotating concrete pin guide and a second rotating concrete pin guide; a plurality of pins; and a first support bracket and a second support bracket each having a height equal to the height of the first and second slide bodies; and wherein the center body is sized and configured for engaged receipt of the first slide body and the second slide body such that each of the first and second slide bodies are slidably adjustable along the center body, and wherein the first and second slide bodies are each secured to the center body using at least one of the plurality of pins.

3 Claims, 4 Drawing Sheets

(56) References Cited

U.S. PATENT DOCUMENTS

| | | | | | |
|---|---|---|---|---|---|
| 4,121,804 | A * | 10/1978 | O'Leary | B28B 7/0017 | 249/157 |
| 4,202,145 | A * | 5/1980 | Coulter | E04B 2/86 | 249/3 |
| 4,516,875 | A * | 5/1985 | Turner | E01C 11/08 | 249/3 |
| 4,659,054 | A * | 4/1987 | Allen | E01C 19/2035 | 249/207 |
| 4,750,703 | A * | 6/1988 | Gentilcore | E01C 19/502 | 249/192 |
| 5,205,942 | A * | 4/1993 | Fitzgerald | E01C 19/502 | 249/3 |
| 6,367,764 | B1 * | 4/2002 | Butler | E02D 27/00 | 249/18 |
| 2015/0252576 | A1 * | 9/2015 | Parr | E01C 19/502 | 249/191 |
| 2016/0201276 | A1 * | 7/2016 | Ganey | E01C 19/4866 | 404/119 |
| 2020/0018020 | A1 * | 1/2020 | White | E01C 19/502 | |

FOREIGN PATENT DOCUMENTS

| | | | | |
|---|---|---|---|---|
| FR | 2650017 | A1 * | 1/1991 | E04G 13/00 |
| GB | 516010 | A * | 12/1939 | E01C 19/502 |

* cited by examiner

ADJUSTABLE CONCRETE FOOTER BULKHEAD

RELATED APPLICATION

This application claims priority to and incorporates entirely by reference U.S. Provisional Patent Application Ser. No. 62/844,484 filed on May 7, 2019.

FIELD OF THE INVENTION

This invention relates to an apparatus for pouring a concrete footer and, more particularly, an adjustable concrete footer bulkhead.

BACKGROUND OF THE INVENTION

It is important to properly pour concrete when building a concrete footing because, otherwise, if the footing is not placed correctly, then the entire structure can be imbalanced or lopsided. Presently, new forms for pouring concrete footers are constructed from wood for each step up in a concrete footer and are generally discarded after each use.

Accordingly, there exists a need for an adjustable concrete footer bulkhead.

SUMMARY OF THE INVENTION

The present invention is directed to an adjustable concrete footer bulkhead for pouring concrete footers, the adjustable concrete footer bulkhead including a center body; a first slide body and a second slide body each having equal heights; a first rotating concrete pin guide and a second rotating concrete pin guide; a plurality of pins; and a first support bracket and a second support bracket each having a height equal to the height of the first and second slide bodies; and wherein the center body is sized and configured for engaged receipt of the first slide body and the second slide body such that each of the first and second slide bodies are slidably adjustable along the center body, and wherein the first and second slide bodies are each secured to the center body using at least one of the plurality of pins.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Figure 1:
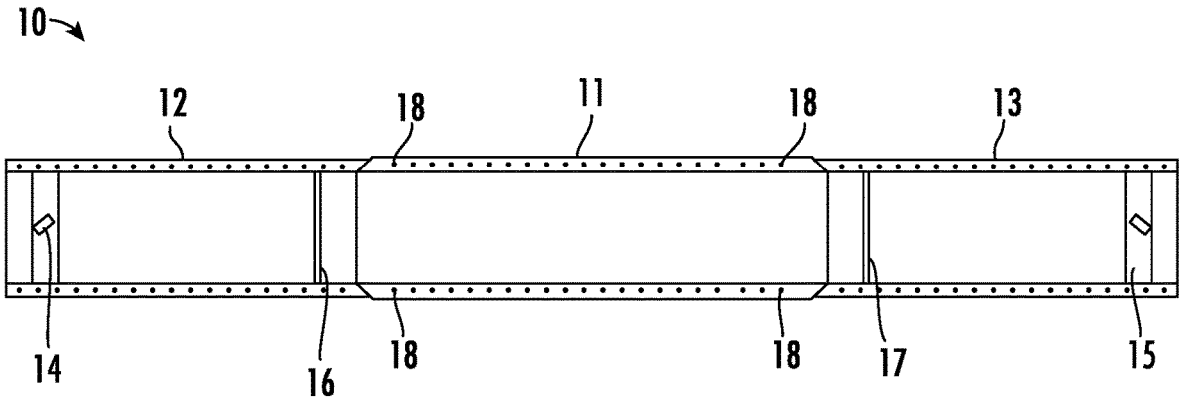
FIG. 1 is a side elevational view of the adjustable concrete footer bulkhead.
Figure 2:
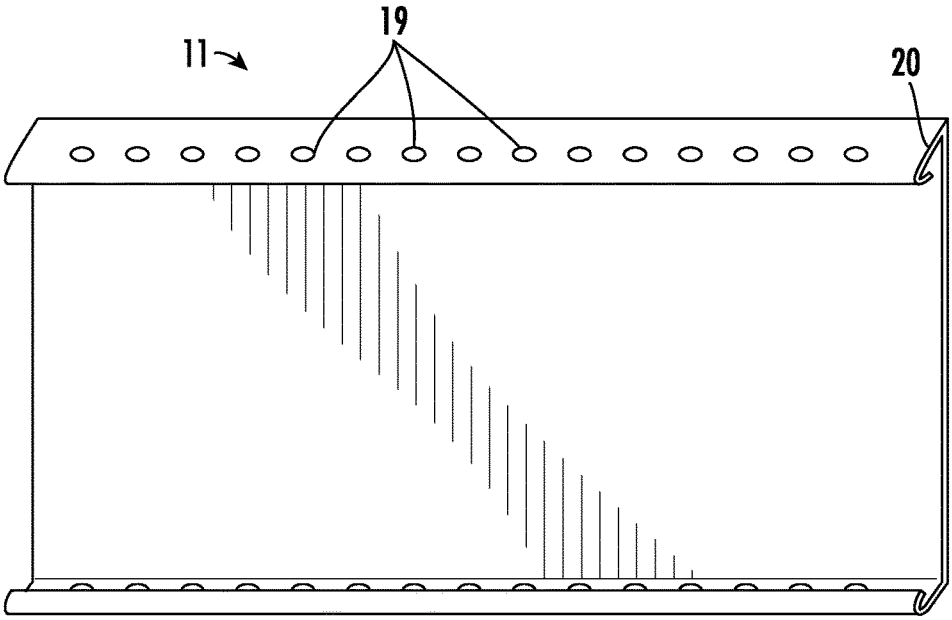
FIG. 2 is a perspective view of the center body.
Figure 3:
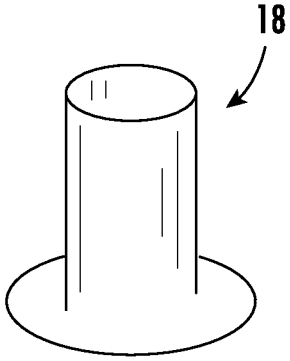
FIG. 3 is a perspective view of a pin.
Figure 4:
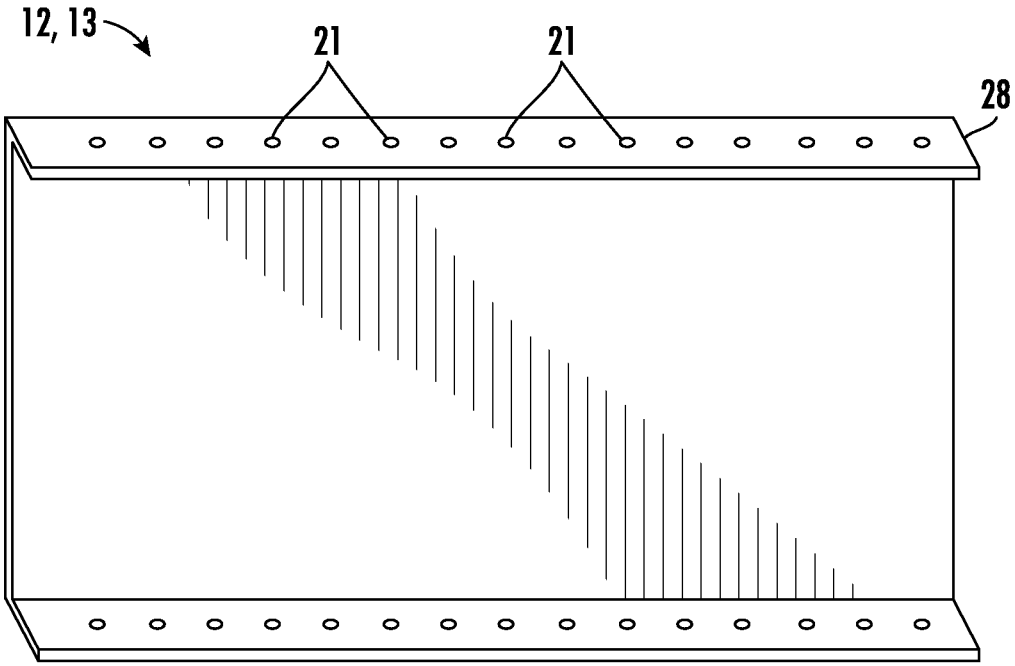
FIG. 4 is a perspective view of the slide body.
Figure 5:
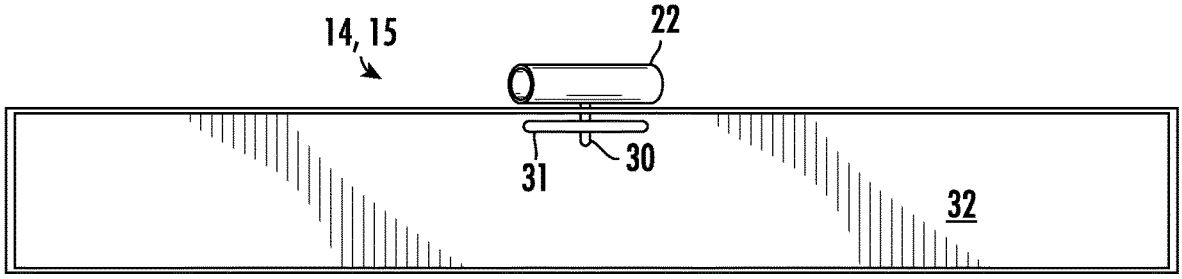
FIG. 5 is a side elevational view of the rotating concrete pin guide.
Figure 6:
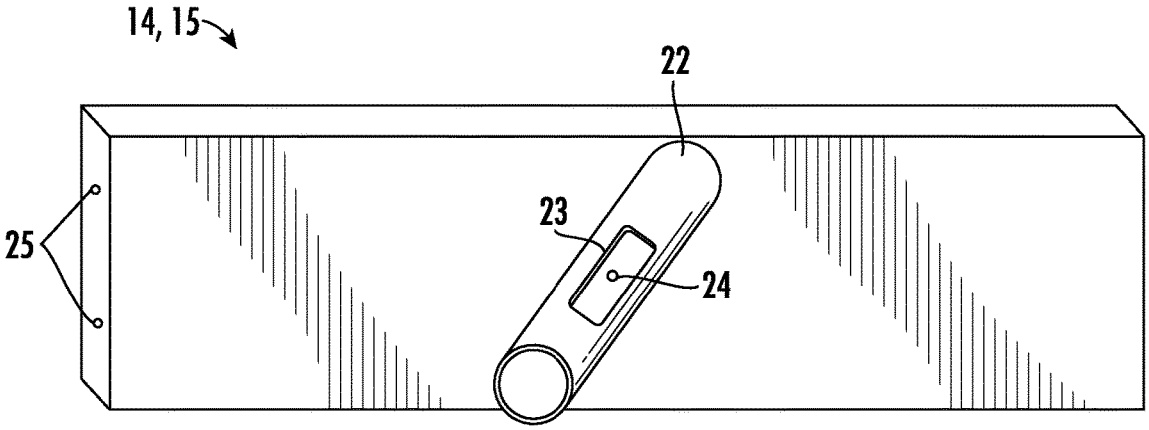
FIG. 6 is a perspective view of the rotating concrete pin guide.
Figure 7:
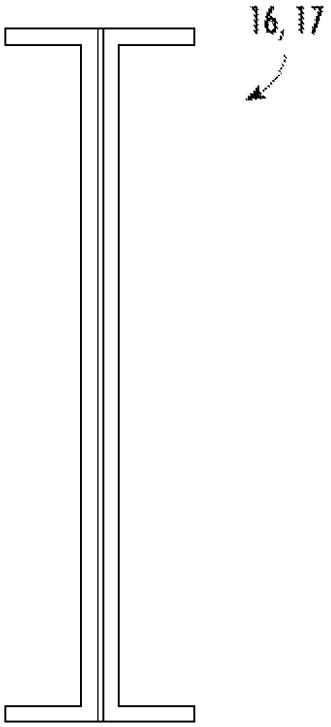
FIG. 7 is a side elevational view of the support bracket.
Figure 8:
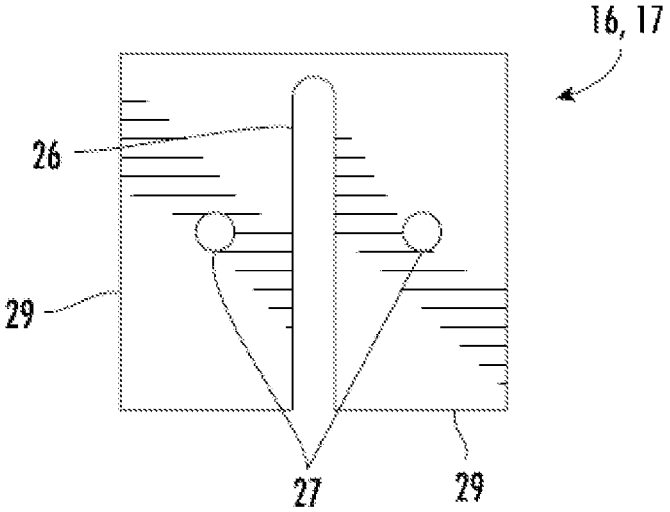
FIG. 8 is a top plan view of the support bracket.

Referring to the several views of the drawings, the adjustable concrete footer bulkhead is shown and described herein and is generally referred to as 10.

The adjustable concrete footer bulkhead 10 can be used multiple times for reducing the long-term costs associated with pouring concrete footers. The height of the adjustable concrete footer bulkhead 10 is 8-inches, which is the height required to match cinder blocks. The sides are adjustable to compensate for various footer widths, and the adjustable concrete footer bulkheads 10 are stackable to accommodate various heights of step ups. The adjustable concrete footer bulkheads 10 are held together by pins that prevent them from separating or bowing.

The adjustable concrete footer bulkhead 10 consists of a center body 11, two slide bodies 12 and 13, two rotating concrete pin guides 14 and 15, two support brackets 16 and 17, and a plurality of pins 18. The first slide body 12 slides into a side of the center body 11 and the second slide body 13 is slid into the other side of the center body 11. The slide bodies 12 and 13 are then adjusted to the desired width, making sure the holes 19 on the center body are in alignment with the holes 21 on the slide bodies 12 and 13. Pins 18 are then inserted through the holes 19 and 21 that overlap between the center body 11 and slide body 12, 13. A rotating concrete pin guide 14, 15 is connected to the slide body 12, 13 close to the end, making sure the holes 25 formed on the rotating concrete pin guide 14, 15 line up with the holes 21 on the slide body 12, 13. Pins 18 are then inserted into the holes 25, 21, thereby joining the rotating concrete pin guide 14, 15 to the respective slide body 12, 13. Support brackets 16 and 17 may be added to the unit if needed for extra support. To connect the support bracket 16, 17, the support bracket 16, 17 is placed onto the corresponding slide body 12, 13, making sure the holes 27 on the support bracket 16, 17 line up with the holes 21 on the corresponding slide body 12, 13, and insert pins 18 into the holes 27, 21 for securing thereto.

The center body 11 is 8-inches tall. There is a 90-degree bend at both the top and bottom of the center body 11 protruding 1-inch and runs the entire length of the center body 11. It bends again creating a J-shape 20 protrusion, curving back towards the main body. The bend 20 has ⅛-inch holes 19 1-inch on center starting from 1-inch from either end of the center body 11 and continuing the length of the center body 11.

The slide body 12, 13 is 8-inches tall minus twice the height if the material used to construct the unit so that it can slide into the center body. The slide body 12, 13 includes 90-degree bends 28 on both the top and bottom. The bends protrude 1-inch minus the thickness of the material used to construct the unit and runs the entire length of the slide body 12, 13. There are ⅛-inch holes 1-inch of center starting one inch from either end of the slide body 12, 13 and continuing the entire length of the slide body 12, 13. The pins 18 have a ⅛-inch diameter with a flat head that has at least a ¼ inch diameter.

The support bracket 16, 17 has a total height equal to the inside height of the slide body 12, 13. The support bracket 16, 17 has flanges 29 that protrude sideways 1-inch from the body of the bracket 16, 17 on a 90-degree angle on the top and bottom of the bracket 16, 17. There is a ⅛-inch hole 27 in the center of each flange 29.

The rotating concrete pin guide 14, 15 is box-shaped having a total height equal to the inside height of the slide body 12, 13. It has a width of 2-inches and a depth of 1 inch. A 1-inch flange 29 protrudes from the top and bottom of each side of the box with a ⅛-inch hole in the center. In the center of the rotating concrete pin guide 14, 15 is a smooth hole. The rotating concrete pin guide 14, 15 has a cylinder 22 that is 2-inches long with an inside diameter of at least 13/16 inch. The cylinder 22 has a rectangular shaped depression 23 on top that allows access to a bolt hole 24 directly below it, in the center of the cylinder 22. A flat headed bolt 30 slides through the bolt hole 24 in the cylinder 11, through the hole in the box and into a threaded disc 31 that is located in the internal cavity 32 surrounded by the rotating concrete pin guide 14, 15. The bolt 30 needs to be smooth from the head to the internal cavity 32 to allow the guide 14, 15 to rotate freely.

While the present invention has been shown and described in accordance with several preferred and practical embodiments, it is recognized that departures from the instant disclosure are contemplated within the spirit and scope of the present invention.

What is claimed is:

1. An adjustable concrete footer bulkhead for pouring concrete footers, the adjustable concrete footer bulkhead comprising:

a center body;

a first slide body and a second slide body each having equal heights;

a first rotating concrete pin guide and a second rotating concrete pin guide;

a plurality of pins; and a first support bracket and a second support bracket each having a height equal to the height of the first and second slide bodies; and wherein the center body is sized and configured for engaged receipt of the first slide body and the second slide body such that each of the first and second slide bodies are slidably adjustable along the center body, and wherein the first and second slide bodies are each secured to the center body using at least one of the plurality of pins.

2. The adjustable concrete footer bulkhead as recited in claim 1 wherein height of the adjustable concrete footer bulkhead is eight inches.

3. The adjustable concrete footer bulkhead as recited in claim 1 wherein the first rotating concrete pin guide and the second rotating concrete pin guide each has a width of 2-inches and a depth of 1-inch.

* * * * *